US008162108B2

(12) United States Patent
Sirigu et al.

(10) Patent No.: US 8,162,108 B2
(45) Date of Patent: Apr. 24, 2012

(54) ELEVATOR HAVING A LIMIT SWITCH FOR CONTROLLING POWER TO THE DRIVE SYSTEM AS AN ELEVATOR CAR APPROACHES A SHALLOW PIT OR A LOW OVERHEAD

(75) Inventors: Gérard Sirigu, Gien (FR); Pascal Rebillard, Gien (FR); Olivier Dukacz, Les Choux (FR); Dominique Goulet, Chatillon sur Loire (FR); Alain Simonot, Gien (FR); Jean-Noel Cloux, Nogent-sur-Vernisson (FR); David Pillin, Saint-Brisson sur Loire (FR); Florence Picard, Griselles (FR); Frédéric Beauchaud, Coullons (FR); Thomas Coquerelle, Douai (FR); Michel Beeuwsaert, Nevoy (FR); Nicolas Fonteneau, Germiny des Pres (FR); Andres Monzon, Alcorcon (ES); Fernando Del Rio, Torrelodones (ES); Peter Herkel, Berlin (DE); Dirk Tegtmeier, Berlin (DE)

(73) Assignee: Otis Elevator Company, Farmington, CT (US)

( * ) Notice: Subject to any disclaimer, the term of this patent is extended or adjusted under 35 U.S.C. 154(b) by 505 days.

(21) Appl. No.: 12/305,697

(22) PCT Filed: Jun. 30, 2006

(86) PCT No.: PCT/IB2006/003219

§ 371 (c)(1),
(2), (4) Date: Dec. 19, 2008

(87) PCT Pub. No.: WO2008/004022

PCT Pub. Date: Jan. 10, 2008

(65) Prior Publication Data

US 2010/0155184 A1 Jun. 24, 2010

(51) Int. Cl.
*B66B 1/06* (2006.01)

(52) U.S. Cl. ..... 187/289; 187/394; 187/301

(58) Field of Classification Search ..... 187/277, 187/286, 287, 293, 305, 391–394, 288, 289, 187/301, 314, 316
See application file for complete search history.

(56) References Cited

U.S. PATENT DOCUMENTS

| | | | | |
|---|---|---|---|---|
| 4,004,655 | A | 1/1977 | Kraft et al. | |
| 5,733,771 | A * | 3/1998 | Lewis et al. | 435/252.3 |
| 6,173,814 | B1 * | 1/2001 | Herkel et al. | 187/288 |
| 6,736,242 | B2 * | 5/2004 | Nygren | 187/357 |
| 7,201,256 | B2 * | 4/2007 | Deplazes et al. | 187/300 |

(Continued)

FOREIGN PATENT DOCUMENTS

| | | | |
|---|---|---|---|
| EP | 0985628 | A2 | 3/2000 |

(Continued)

*Primary Examiner* — Anthony Salata
(74) *Attorney, Agent, or Firm* — Carlson, Gaskey & Olds PC

(57) ABSTRACT

The elevator has a car movable vertically within a shaft between lower and upper end positions and a drive system coupled to a traction system for controlling movement of the car. A limit switch which is open when the car is in a selected distance range from one of the end positions. The limit switch forms part of a power line supplying power to the drive system for controlling movement of the car in a direction towards that end position in an inspection operation. Thus movement of the car is prevented only in that direction when the car is in the selected distance range in an inspection operation.

7 Claims, 10 Drawing Sheets

U.S. PATENT DOCUMENTS

| | | | | |
|---|---|---|---|---|
| 7,228,943 | B2 * | 6/2007 | Kugiya et al. | 187/393 |
| 7,278,517 | B2 * | 10/2007 | Gut | 187/300 |
| 7,533,763 | B2 * | 5/2009 | Kattainen et al. | 187/394 |
| 7,575,100 | B2 * | 8/2009 | Kugiya et al. | 187/305 |
| 7,650,969 | B2 * | 1/2010 | Monzon et al. | 187/300 |
| 7,832,526 | B2 * | 11/2010 | Sirigu | 187/357 |
| 7,891,467 | B2 * | 2/2011 | Kattainen et al. | 187/394 |
| 7,980,363 | B2 * | 7/2011 | Kattainen et al. | 187/391 |
| 2004/0222046 | A1 | 11/2004 | Gut | |
| 2010/0155182 | A1 * | 6/2010 | Ueda et al. | 187/280 |

FOREIGN PATENT DOCUMENTS

| | | | |
|---|---|---|---|
| EP | 1110900 | A1 | 6/2001 |
| EP | 1118574 | A2 | 7/2001 |
| EP | 1319626 | A1 | 6/2003 |
| EP | 1422182 | A1 | 5/2004 |
| EP | 1440930 | A2 | 7/2004 |
| EP | 1674416 | A1 | 6/2006 |
| GB | 2158038 | A | 11/1985 |
| JP | 4199216472 | | 1/1992 |
| JP | 6107385 | A | 4/1994 |
| JP | 2002114462 | A | 4/2002 |
| WO | 2005026033 | A1 | 3/2005 |
| WO | 2005092774 | A1 | 10/2005 |
| WO | 2005105644 | A1 | 11/2005 |
| WO | 2005105645 | A1 | 11/2005 |
| WO | 2005121015 | A2 | 12/2005 |
| WO | 2006035264 | A1 | 4/2006 |
| WO | 2006062503 | A1 | 6/2006 |
| WO | 2006082461 | A1 | 8/2006 |

* cited by examiner

FIG. 8
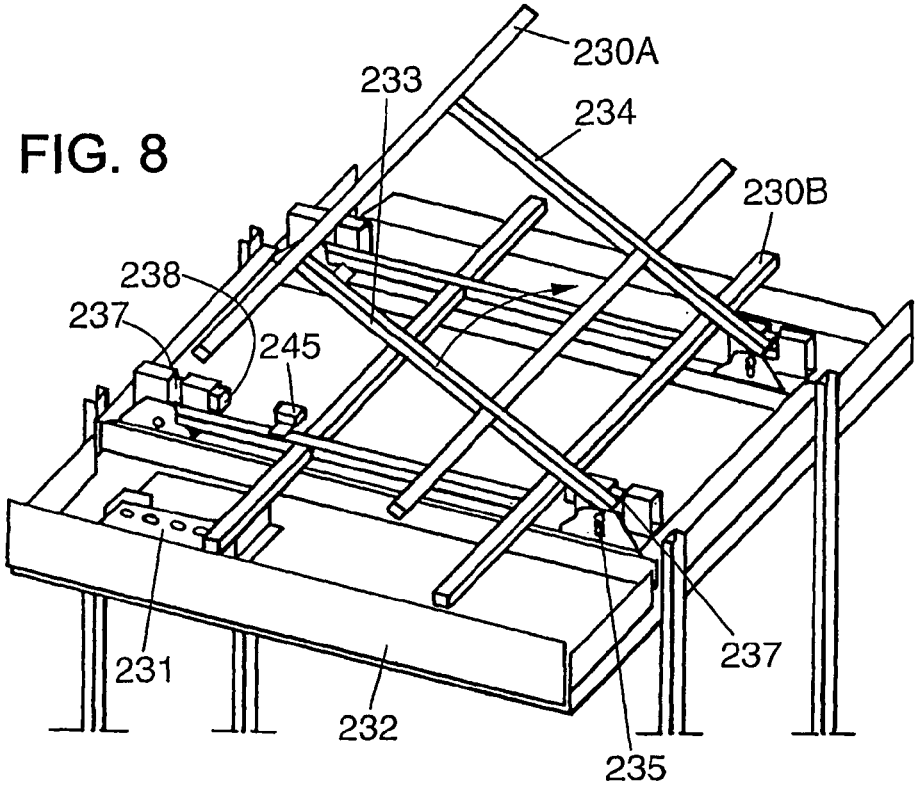
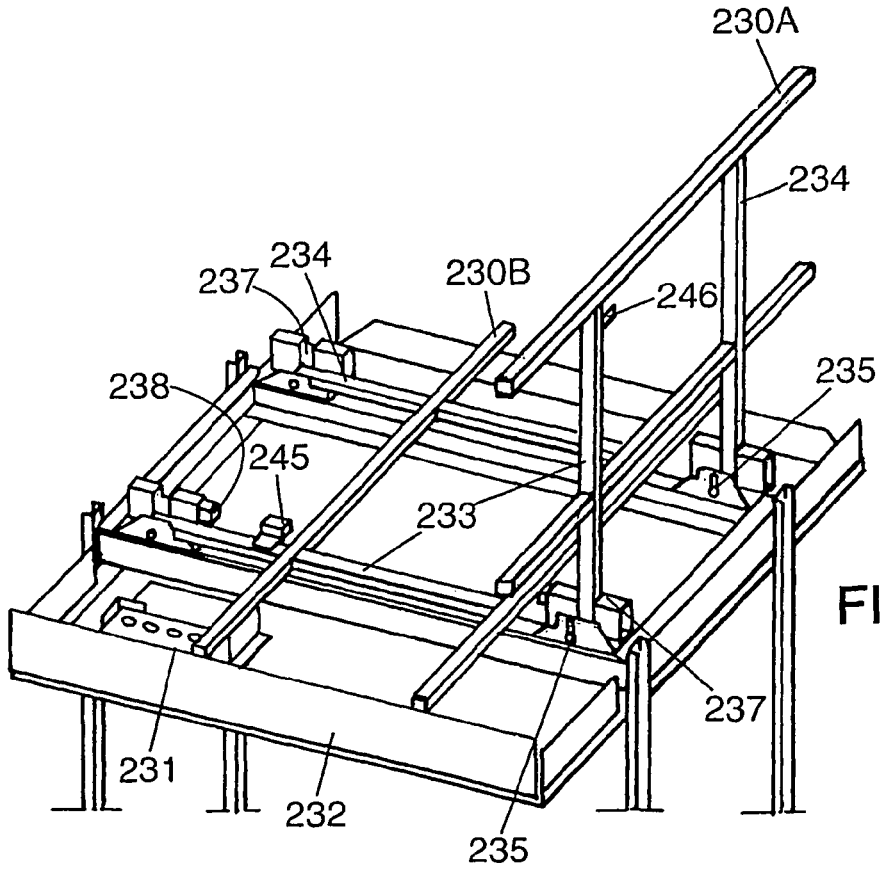
FIG. 9

FIG. 12
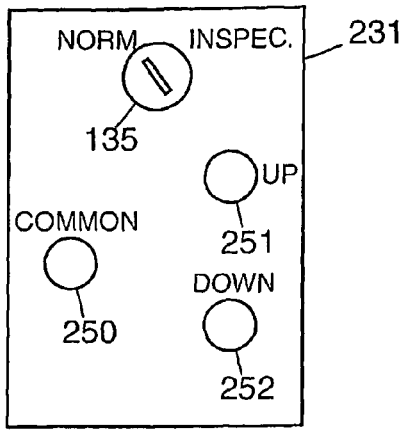
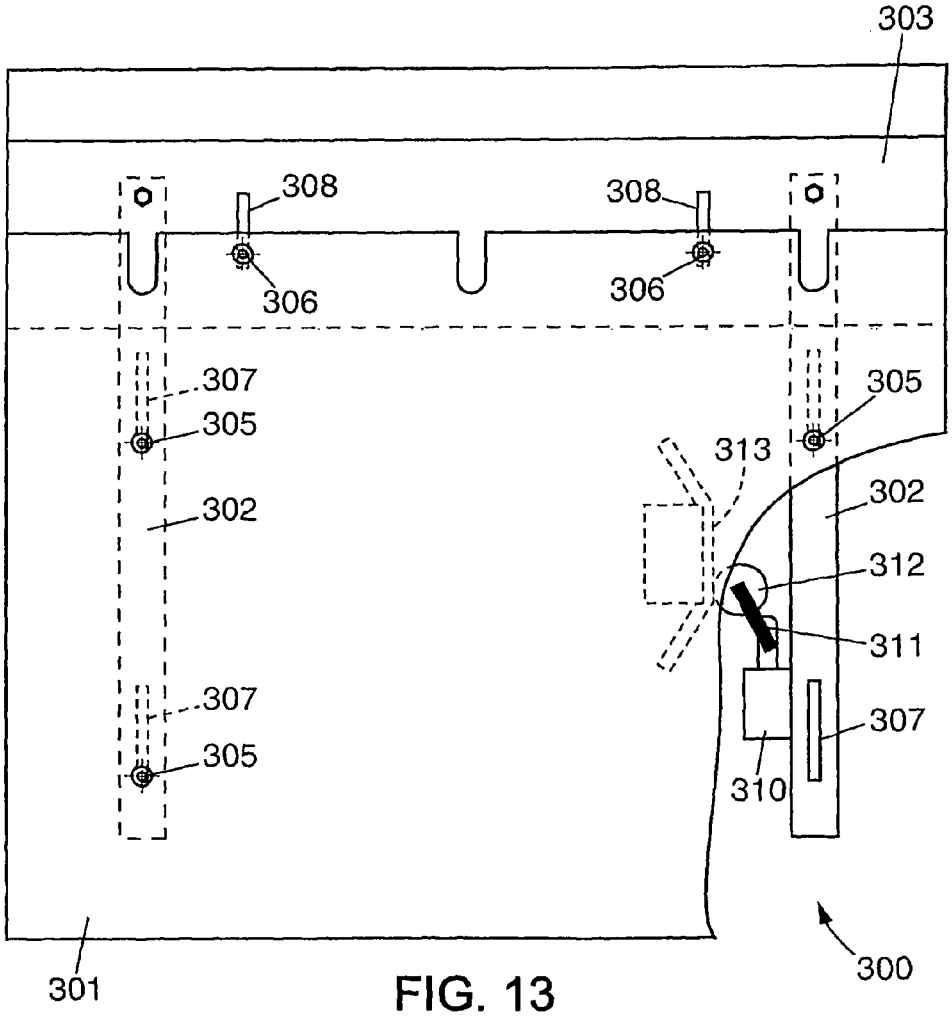
FIG. 13

ELEVATOR HAVING A LIMIT SWITCH FOR CONTROLLING POWER TO THE DRIVE SYSTEM AS AN ELEVATOR CAR APPROACHES A SHALLOW PIT OR A LOW OVERHEAD

BACKGROUND OF THE INVENTION

The present invention relates to elevators. It applies, in particular, to elevators having a shallow pit and/or a low overhead.

Elevators with a shallow pit and/or a low overhead are advantageous because of the reduced impact of their installation on the construction cost and because of their compatibility with severe architectural constraints.

Machine room-less elevators have their drive system, in particular their motor and brake, located inside the volume of the elevator shaft. Access to these parts, and to other components fitted in the shaft is required for maintenance or repair purposes. Standards such as EN81 require safety clearances at the top and at the bottom of the shaft so that a person can enter a safe working space to have access to the machines and shaft components. Such working space can be located in the upper part of the hoistway, with the operator standing on top of the car, or in the pit at the bottom of the shaft.

Safety measures to make sure that the minimum safety volume is always achieved in an inspection operation have been proposed. For example, the motor and the brake are deactivated to stop movement of the car if it is detected that the car is located out of a height range defined for inspection travel, the height range providing minimum working space at the top and/or bottom of the shaft to allow a mechanic to stand on top of the car or at the bottom of the pit and have access to various parts. It is also possible to take advantage of the safety brake usually present in the elevator structure to prevent the car from traveling at an excessive speed. In this case, the safety brake is triggered by a stop member located at a specified height in the shaft, the stop member being retracted during normal operation of the elevator to let the car reach the lowest and highest landing levels (see, e.g., US 2004/0222046 and WO 2006/035264).

SUMMARY OF THE INVENTION

According to an embodiment of the invention, an elevator comprises:

- a car movable vertically within an elevator shaft between lower and upper end positions;
- a drive system coupled to a traction system for controlling movement of the car; and
- at least one limit switch which is open when the car is in a selected distance range from one of the end positions, the limit switch forming part of a power line supplying power to the drive system for controlling movement of the car in a direction towards said one of the end positions in an inspection operation such that movement of the car is prevented only in said direction when the car is in said distance range in an inspection operation.

When a mechanic enters the hoistway, he may have to move the car in an inspection travel, in order to bring it near the upper end of the shaft to have access to machinery or components located at the top, or near the pit to have access to other components located under the car. This must be done while securing a safe working space above the car and/or in the pit.

It can happen that, once the mechanic has manually opened the highest or lowest landing to enter the shaft, the car is located above the position corresponding to the upper limit switch or below the position corresponding to the lower limit switch. In a low overhead configuration (it will be appreciated that similar considerations apply symmetrically in the shallow pit case), the mechanic typically calls the cars at the upper landing level and stops its movement by manually opening the landing door by means of a triangle key or similar tool. He usually wishes the car to stop at a position where he can clamber on top of it without having to move the car too long afterwards to reach the desired working position (in the inspection mode, the car speed is much reduced compared to the normal mode and such movement can be a waste of time). So he aims at stopping the car close to the limit switch. But this is tricky because most of the time the car cannot be seen by the mechanic and the distance needed for the brake to effectively stop the car must be taken into consideration. A bad aim can cause the car to stop just above the limit switch, and the mechanic may not wish to spend time in the procedure for closing the door, bringing the elevator back into the safe normal mode and trying again. The arrangement of the limit switch in the power line according to this embodiment of the invention makes is possible for the mechanic to get on top of the car if he considers that he has enough room and then to control a short downward inspection travel to bring the car at the most convenient level. Of course, safety provided by the limit switch precludes the car to move further up in such circumstances.

This embodiment thus provides an inspection operation which is both safe and efficient.

It can be combined with other safety measures associated with the safety brake used for stopping the car when triggered, usually in response to detection of an overspeed condition. A retractable stopping element is then deployed in an inspection operation for engaging a triggering member of the safety brake when the car moving in the direction towards said one of the end positions reaches a selected distance within said distance range so as to secure a safety space independently of the drive system at the end position in the inspection operation.

Another embodiment of the invention, which may be implemented in combination with the above or separately, relates more particularly to an elevator having a low overhead configuration, which then comprises:

- a car movable vertically within an elevator shaft;
- a drive system coupled to a traction system for controlling movement of the car;
- a foldable handrail mounted on top of the car;
- a plurality of safety switches associated with the foldable handrail, the safety switches comprising a first safety switch closed only when the handrail is folded in a fully retracted position and at least one second safety switch closed when the handrail is unfolded in a fully deployed position; and
- a safety chain comprising a normal operation branch including said first safety switch for supplying power to the drive system in a normal operation of the elevator and an inspection operation branch including said at least one second safety switch for supplying power to the drive system in an inspection operation of the elevator.

Handrails are used on top of elevator cars to avoid hazards for people standing there. They must be foldable in low overhead configurations so as to occupy a very limited height, e.g. less than 10 cm. Examples of such foldable handrail arrangements are disclosed in WO 2005/026033 and WO 2005/105645. The above embodiment of the invention secures the right positioning of the handrail while the car is moving both in normal elevator operation and in inspection operation.

Another embodiment of the invention, which may be implemented in combination with the above or separately, relates more particularly to an elevator having a shallow pit configuration, which then comprises:

- a car movable vertically within an elevator shaft between lower and upper end positions;
- a drive system coupled to a traction system for controlling movement of the car;
- a limit switch which is closed when the car is within a selected distance from the lower end position and open when the car is beyond the selected distance from the lower end position;
- a retractable toe guard mounted at the bottom of the car;
- a safety switch which is closed only when the toe guard is in a fully deployed position; and
- a power line for supplying power to the drive system in a normal operation of the elevator, said power line including a parallel arrangement of the limit switch and of the safety switch.

An elevator toe guard extends downwardly from the lower front sill of an elevator car. The toe guard is an important safety feature since it provides a barrier between a landing and the hoistway when the car is not aligned with the landing. For example should the car become trapped between floors, the toe guard reduces the danger of a person attempting to rescue the passengers, or the passengers themselves, falling into the hoistway. Regulations and good safety practice dictate a minimum height for toe guards. Clearly in order to accommodate such a toe guard fixed to the bottom of an elevator car, the pit must be sufficiently deep that the toe guard will not strike the bottom of the pit even if the elevator travels below the lowest landing and onto the buffers. As this condition is not always fulfilled in shallow pit elevators, retractable toe guards have been proposed. An example is disclosed in WO 2005/092774. Such a toe guards retracts when it contacts the bottom of the pit while the car reaches the lowest landing level in normal operation. The switch associated with the toe guard in this aspect of the invention make it possible to check that the toe guard does not become jammed in a retracted position, or in a not fully deployed position, prior to enabling normal operation of the elevator, thus guaranteeing the safety feature of the toe guard.

Another embodiment of an elevator according to the present invention, which may be implemented in combination with the above or separately, comprises:

- a car movable vertically within an elevator shaft;
- a drive system coupled to a traction system for controlling movement of the car;
- a plurality of landing doors providing access to the shaft;
- a plurality of door safety devices each coupled to a latch mechanism of a respective landing door, each door safety device having a door release input for releasing the latch mechanism of the respective landing door in response to a first user action performed outside the shaft, and a bi-stable switch which is opened in response to said first user action and closed in response to a second user action performed outside the shaft, the second user action being enabled only when the respective landing door is completely closed;
- an inspection control interface located inside the shaft, comprising a mode switch closed by a user to enter an inspection operation of the elevator in which movement of the car is restricted; and
- a safety chain comprising a plurality of series-connected switches for supplying power to the drive system, the plurality of series-connected switches comprising at least one of the bi-stable lock switches bypassed by a branch including said mode switch.

This provides a simple and safe arrangement of an intrusion detector for the shaft. Movement of the car is inhibited once the mechanic has released a landing door to access the shaft. Then, an inspection travel can be performed if the mechanic actuates the mode switch from inside the shaft (the car roof or the pit). When the elevator is brought back to the normal mode of operation, the car is only permitted to move after the mechanic has checked out of the shaft by performing the second action on the safety device of the door by which he came in.

BRIEF DESCRIPTION OF THE DRAWINGS

FIGS. 8-11 are diagrammatic perspective views of an example of foldable handrail device which can be arranged on top of the elevator car.

FIG. 12 shows a control panel which can be arranged on top of the elevator car.

FIG. 13 is a front view of an example of toe guard used in certain embodiments of the invention.

DESCRIPTION OF PREFERRED EMBODIMENTS

Figure 1:
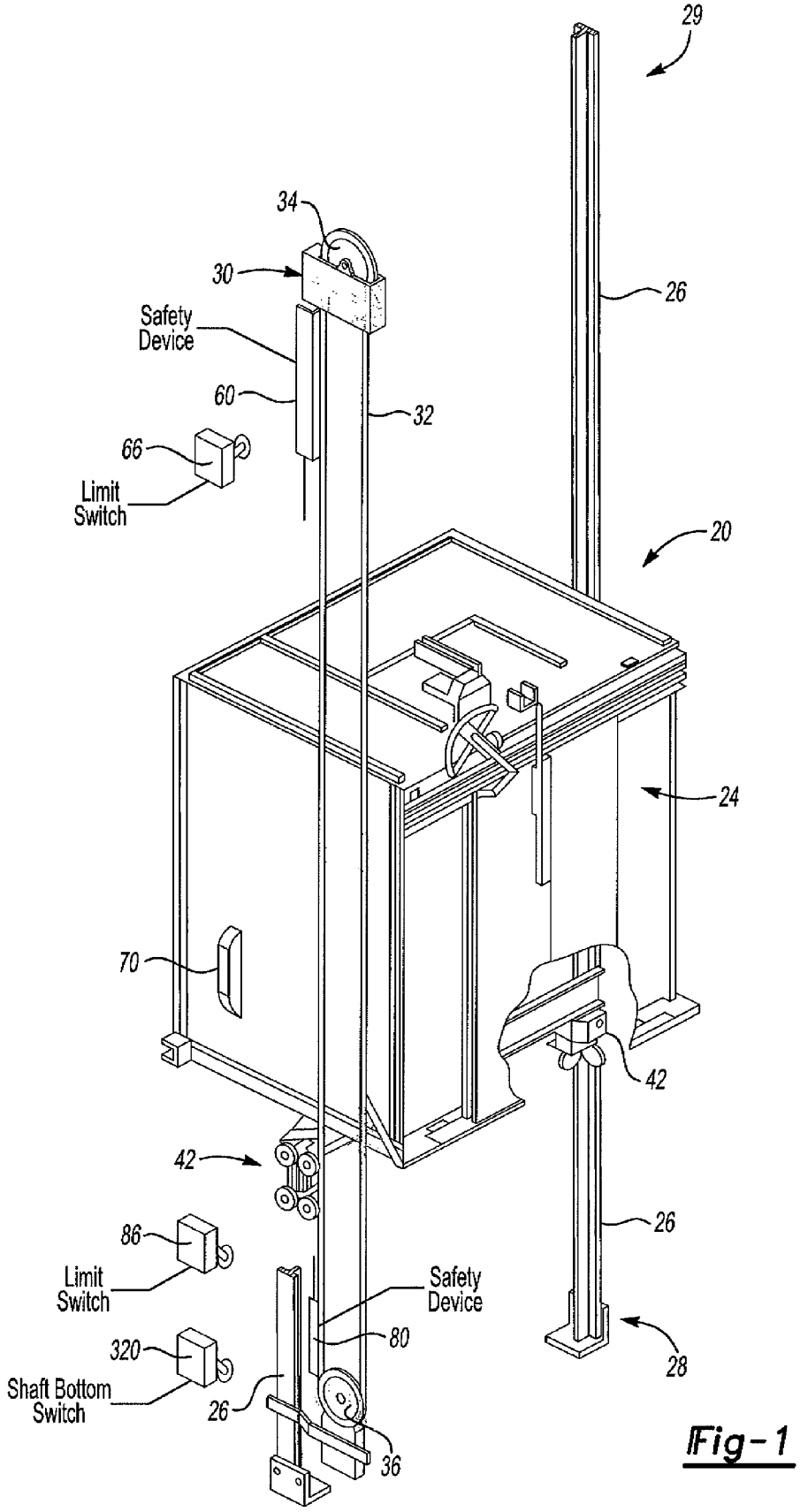
FIG. 1 schematically illustrates selected portions of an embodiment of an elevator to which the present invention is applicable.

FIG. 1 shows an elevator system 20 including an elevator car 24 that moves along guide rails 26 in a known manner.

In one example, a machine room-less elevator system allows the car 24 to move essentially along the entire length of a hoistway between a lower end 28 (i.e. a pit) and an upper end 29 of a hoistway. A drive system (not shown) including a motor and a brake is conventionally used to control the vertical movements of the car 24 along the hoistway via a traction system partly visible in FIG. 2, including cables or belts 25 and reeving pulleys 27.

In addition, a governor device 30 controls movement of the car 24 by preventing it from moving beyond a selected maximum speed. The example governor device 30 includes a governor rope 32 that travels with the car 24 as the car moves along the guide rails 26. A governor sheave 34 and a tension sheave 36 are at opposite ends of a loop followed by the governor rope 32.

The illustrated governor device 30 operates in a known manner. In the event that the car 24 moves too fast, the governor device 30 exerts a braking force on the governor sheave 34. That causes the governor rope 32 to pull upon a mechanical linkage to activate safety brakes 42 shown diagrammatically in FIG. 1. In this example, the safety brakes apply a braking force against the guide rails 26 to prevent further movement of the elevator car 24. A variety of safety brakes 42 for this purpose are known. Connecting rods may be arranged in a known manner above the car roof and/or below the car floor to synchronize the operation of safety brakes cooperating with respective guide rails disposed on both sides of the car.

Figure 2:
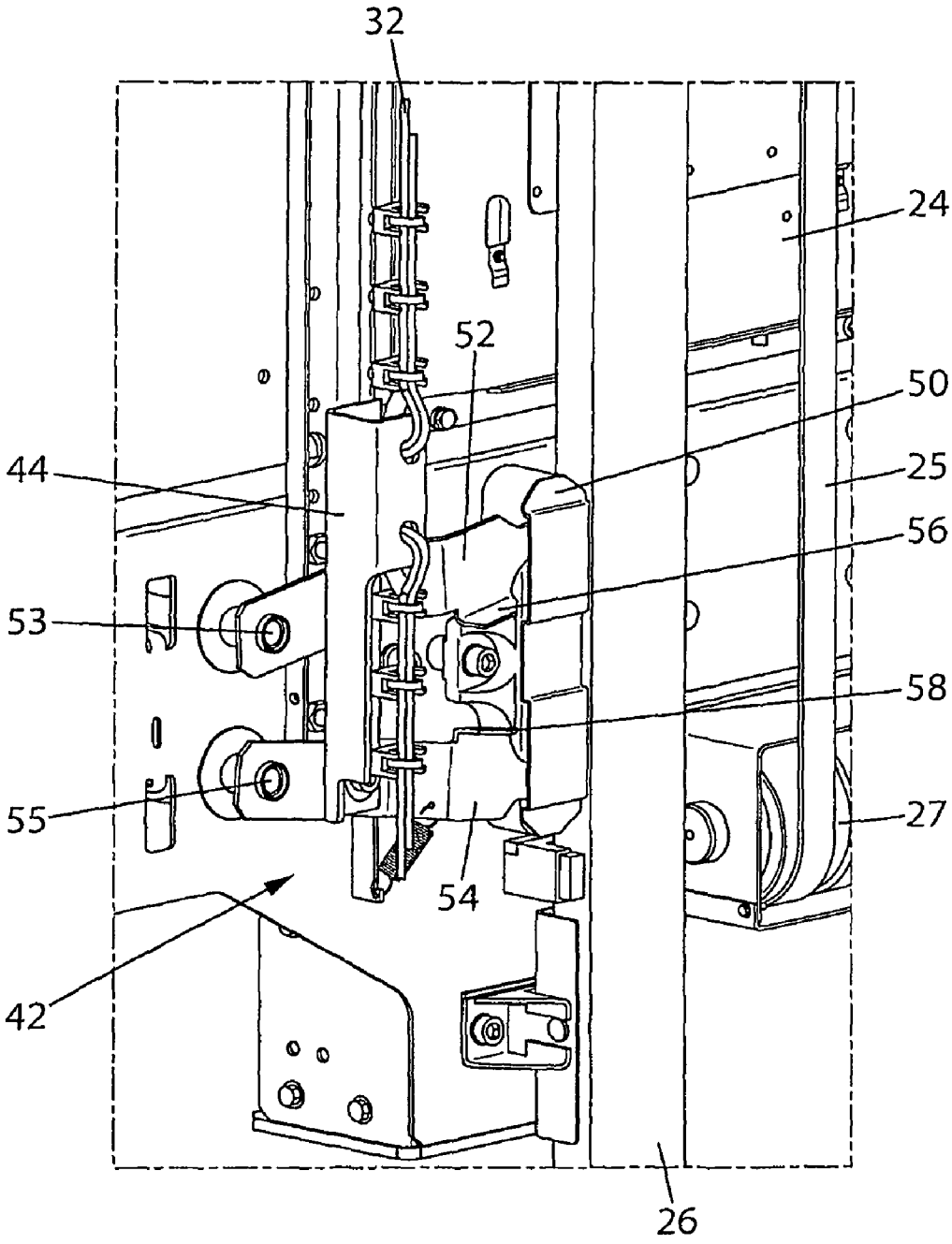
FIGS. 2 and 3 are perspective views of a safety brake and of a safety device usable in such an elevator.

FIG. 2 shows a possible arrangement of the safety brake 42. A safety gear 50 is fixed to the car structure so as to slide along the guide rail 26. Triggering of the gear 50 generates friction along the rail 26 and the gear is conventionally disposed to amplify the friction by a wedge action until the car is stopped. The exemplary safety brake shown in FIG. 2 has a dual action. It can be triggered either by an upper lever 52 to block upward movement of the car 24 or by a lower lever 54 to block downward movement of the car 24. Each triggering lever 52, 54 is articulated to the car structure about a respective pivot axis 53, 55. The governor rope 32 has its two ends attached to a linkage 44. The linkage 44 extends substantially vertically and is articulated to the two triggering levers 52, 54 in a middle portion of these levers. Hence, when the governor rope 32 is retained due to an overspeed condition while the car 24 moves downwards (upwards), the lower lever 54 (upper lever 52) is pulled by the rope 32 to trigger the safety gear 50 and stop the car 24.

In addition, the triggering levers 52, 54 shown in FIG. 2 have lateral extensions 56, 58 between the safety gear 50 and the articulation of the pulling rod 44. The lateral extensions 56, 58 project outwardly to interact with safety devices described further below.

The arrangement of FIG. 1 includes two safety devices 60, 80 positioned at selected heights within the hoistway. The safety devices 60, 80 interact with at least one of the safety brakes 42 under selected conditions to prevent the car assembly 24 from moving too close to the upper end 29 of the hoistway and too close to the lower end 28 of the hoistway, respectively. If needed, other such devices may be strategically placed within the hoistway. Given this description, those skilled in the art will realize how many of such devices are desirable and will be able to select an appropriate location for them to meet the needs of their particular situation.

While the governor device 30 operates depending on a speed of elevator car movement, the safety devices 60, 80 operate depending on the vertical position of the elevator car 24.

Figure 3:
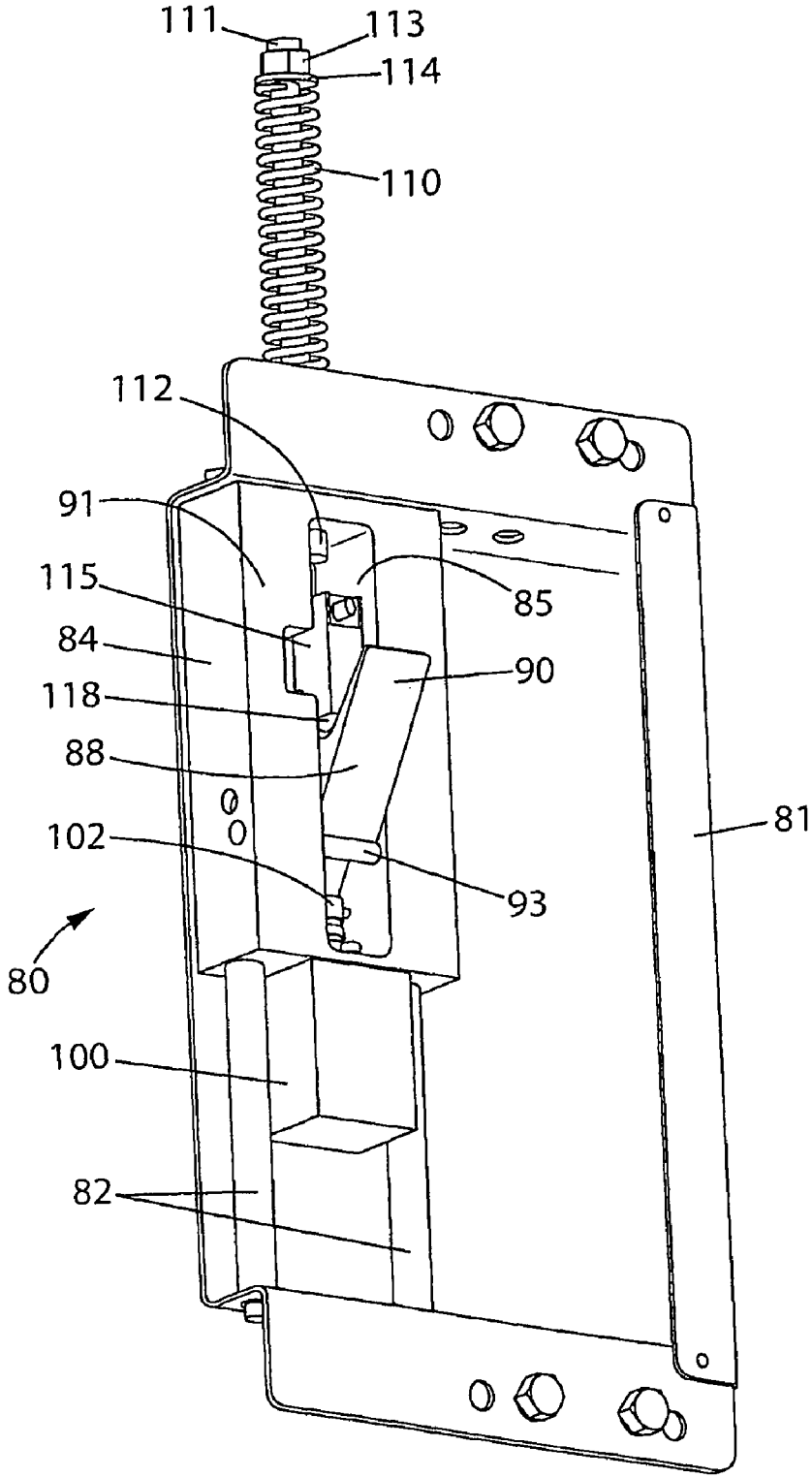
Figure 4:
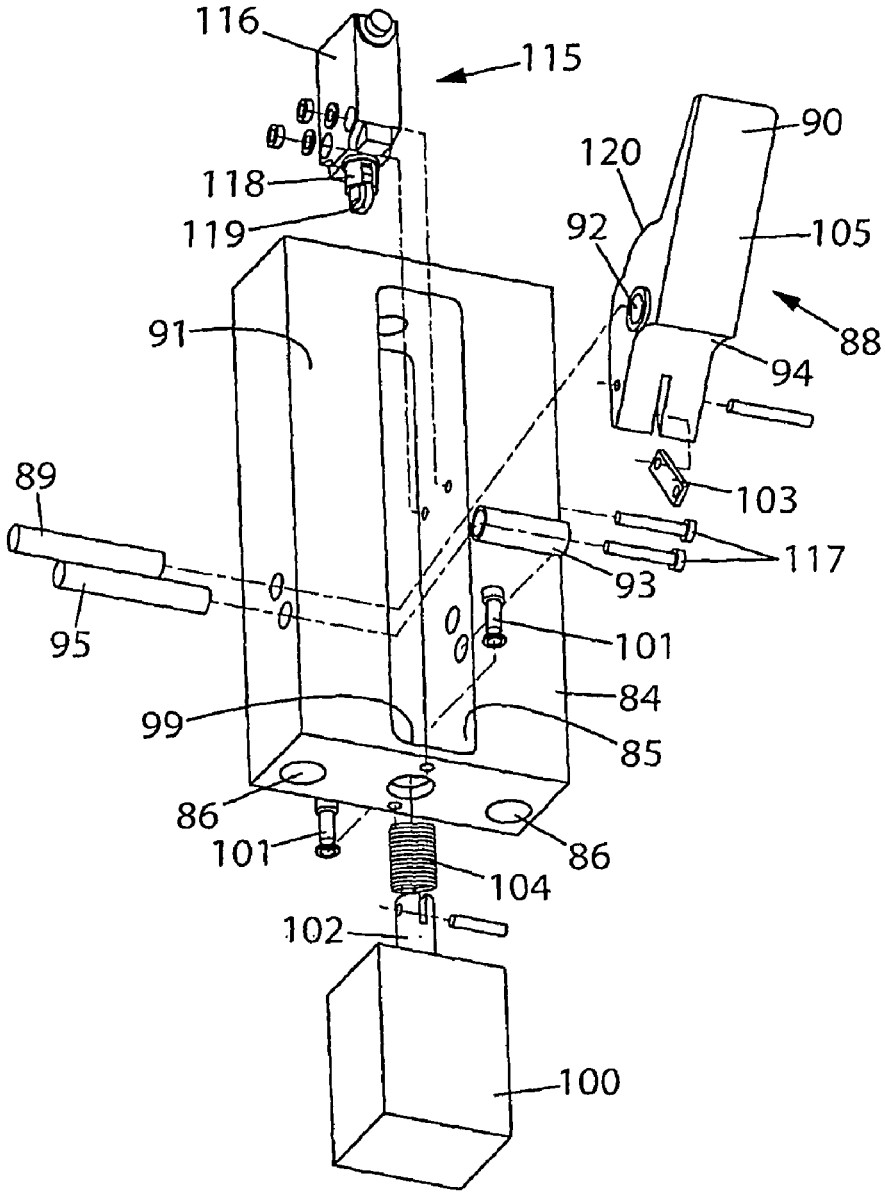
FIG. 4 is an exploded view of part of the safety device of FIG. 3.

An example of lower safety device 80 is shown in FIG. 3. This example includes a bracket 81 to be fixed, at the selected height, to a guide rail 26 or to the shaft wall close to the guide rail 26. The bracket 81 has vertical guide rods 82 for slidably receiving a movable assembly or carriage whose components are shown in FIG. 4. The movable assembly includes a support block 84 formed with a vertical, longitudinal slot 85 in its center. On both sides of the slot 85, two cylindrical through holes 86 receive the guide rods 82.

A retractable stopping element 88 is pivotally mounted within the central slot 85 about a horizontal pivot axis 89. The stopping element 88 has a catch portion 90 which projects from the front surface 91 of the support block 84 when deployed in the stopping position shown in FIG. 3. The center of gravity of the retractable stopping element 88 is located in front of the cylindrical bore 92 receiving the pivot axis 89, so that the element 88 naturally falls into its stopping position. In that position, the lower surface 94 of the stopping element 88 rests on an abutment extending across the slot 85. In the example, the abutment consists of a sleeve 93 held within the slot by a horizontal pin 95.

An actuator 100 is fixed by screws 101 at the lower end of the support block 84. The actuator 100 has an arm 102 which extends through the lower part 99 of the block 84 into the slot 85. A connecting rod 103 is articulated between the tip of actuator arm 102 and the lower end of the retractable element 88. A helical spring 104 is disposed around the actuator arm 102 between the lower part 99 of the block 84 and the pin holding the connecting rod 103 on the actuator arm 102. The spring 104 is compressed to urge the element 88 towards its stopping position. The actuator 100 includes an electromagnet which is powered by the elevator control circuitry in selected circumstances. When powered, the electromagnet pulls the actuator arm 102 to bring the element 88 into its retracted position in which its front surface 105 comes approximately flush with the front surface 91 of the support block 84. In this retracted position, the element 88 does not interfere with the safety brake triggering levers 52, 54.

In the stopping position of the retractable element 88, the catch portion 90 lies in the trajectory of the lateral extension 58 of the lower triggering lever 54 of the safety brake. If the car 24 traveling downwards reaches the level of the lower safety device 80 in its stopping position, the catch portion 90 of element 88 bearing on the abutment 93 lifts the triggering lever 54 to stop the car.

If the car 24 comes from the bottom of the pit and moves upwards, the lateral extensions 56, 58 of the safety brake triggering levers engage the front surface 105 of the retractable stopping element 88. Since the weight of the element 88 and the strength of spring 104 are low compared to the force needed to trigger the safety brake 42, the stopping element 88 is pushed towards its retracted position and the car can continue its upward travel. Gravity and the action of spring 104 immediately bring element 88 back to its stopping position.

A spring arrangement is provided to mount the support block 84 on the bracket 81 of the safety device 80. This arrangement accommodates a vertical sliding movement of the support block 84 when the safety device 80 triggers the safety brake 42, thus accounting for the distance needed for the safety brake to completely stop the car.

In the embodiment shown, the spring arrangement includes a helical spring 110 mounted around a cylindrical rod 111. The rod 111 has a threaded end portion which extends through a hole provided in the upper end of the support block 84 and through a corresponding hole provided in the upper part of the bracket 81. A bolt 112 is screwed on this threaded end portion within the slot 85 to attach the rod 111 to the support block 84. The opposite end of the rod 111 is also threaded to receive another bolt 113 and a washer 114. The helical spring 110 is compressed between the upper part of the bracket 81 and the washer 114, which maintains the support block in the upper position shown in FIG. 3 as long as the retractable element 88 is not hit by the safety brake triggering lever. The spring 110 is so designed that its strength is sufficient to cause the triggering of the safety brake when the element 88 catches the lever 54 and its stroke is at least equal to the maximum distance needed to stop the car by the safety brake. A typical requirement for such a stroke is about 200 mm.

The safety device 80 is also fitted with a position sensor 115 of which an exemplary embodiment is shown in FIGS. 3-4. In this embodiment, the sensor 115 includes a housing 116 attached to the support block 84 within the slot 85 by means of screws 117. A switch located within the housing 116 has its state controlled by the position of a retractable arm 118 having a roller 119 mounted at its distal end. The arm 118 is biased towards its extended position and the roller 119 follows a cam surface 120 provided on the rear side of the retractable stopping element 88. Accordingly, the sensor switch is closed when the retractable element 88 is fully deployed in its stopping position, and otherwise open.

The safety device 80 described above in relation to its positioning near the bottom of the pit to stop the car traveling downwards (shallow pit configuration) can be used symmetrically near the top of the shaft to stop the car traveling upwards in a low overhead configuration. It suffices to install the device upside-down as compared to what has been previously described (see the positioning of device 60 diagrammatically shown in FIG. 1).

Since the safety brake 42 is not easily released once activated, it is not desired to actuate it via one of the safety devices 60, 80 when an inspection operation is carried out without any failure or abnormal situation. Upper and lower limit switches 66, 86 (FIG. 1) are preferably installed near the safety devices 60, 80 to be primarily used to stop the car at the ends of the inspection travel, the safety devices 60, 80 being used as backup to provide an additional level of safety if an anomaly occurs.

To secure a convenient working space on top of the car for a mechanic to have access to machinery installed on top of the shaft, an interval of about 1,800 to 2,000 mm from the car roof to the shaft ceiling is needed. The upper limit switch 66 is disposed at a corresponding level in the shaft (adjacent to the highest landing level), to be opened by a cam surface 70 mounted on the car structure when the car reaches a vertical level corresponding to such an interval. Opening of switch 66 in an upward inspection travel causes the car to be stopped by the electrically-controlled brake of the drive system. Likewise, the lower limit switch 86 is positioned to be opened by the cam surface 70 (or another cam) mounted on the car structure when the car reaches a vertical level adjacent to the lowest landing level which leaves a working space whose height is about 1,800 to 2,000 mm above the pit floor. Opening of switch 86 in a downward inspection travel causes the car to be stopped by the electrically-controlled brake.

If, for any reason, the car moving upwards (downwards) in an inspection operation unexpectedly exceeds the level of the upper (lower) limit switch 66 (86) by more than the maximum stopping distance of the car with the electrically-controlled brake, the safety device 60 (80) located just after the limit switch may come into play to safely stop the car 24 by means of the safety brake 42.

It is sometimes useful to provide two levels of safety relatively close to each other for stopping the car traveling in a given direction. This can typically occur near the top of the shaft in a low overhead configuration (in a shallow pit configuration the presence of a toe guard may make this feature unnecessary as those skilled in the art will appreciate from the following discussion). If a first safety device as described hereabove is provided just above the car level associated with the upper limit switch 66, at a distance sufficient for the car to be normally stopped by the electromagnetic brake without hitting the stopping element 88, an interval of about 1,400 to 1,700 mm between the car roof and the shaft ceiling is left when the car is stopped on this first safety device.

Access to the car roof is typically performed by manually opening a landing door with a special key, which opens a switch to break the safety chain and stop the car by means of the drive system. The mechanic can then clamber on top of the car to carry out the required maintenance or repair operations. It can happen that someone manually opens the door of the highest landing level while the car is located just above the vertical position corresponding to the first safety device, for example with an interval of about 1,600 mm between the car roof and the shaft ceiling. With a low overhead elevator configuration, the distance between the shaft ceiling and the upper lintel of the highest landing door may be of, e.g., about 500 to 700 mm which means, in our example, that a gap of about 1000 mm or more may remain above the car roof while the landing door is open and the car has been stopped above the positions of both the switch and the safety device. This is sufficient for the mechanic to climb on top of the car or for an intruder to sneak in. If this occurs, such a person has no more mechanical protection against a further upper movement of the elevator car.

It may thus be useful to provide a second level of safety by installing two successive safety devices both oriented to stop upward travel of the car. The uppermost device secures an ultimate safety volume complying with the minimum safety volume specified in the relevant standard such as EN-81. The distance between the car roof and the shaft ceiling while the upper triggering lever 52 hits the retractable element of the upper safety device is for example of about 1,000 mm, so that after the safety brake has stopped the car, the gap between the car roof and the upper lintel of the highest landing door has a height of about 300 mm, insufficient for someone to enter the shaft.

The two retractable stopping elements located adjacent the highest landing level to maintain the working and ultimate safety volumes above the car are vertically offset with a fixed distance of about 800 mm between them. A problem arises that such a distance may be too small to arrange in series two safety devices as described with reference to FIGS. 3-4. The dimension of the spring 110 is substantial because it is a strong spring (to effectively trigger the safety brake 42) with a long stroke of about 200 mm. If we also take into account the dimensions of the support block 84 and of the bracket 81, whose construction must be robust, we see that the dimensional constraints may prevent from arranging a series of two safety devices to provide the desired stopping levels.

Figure 5:
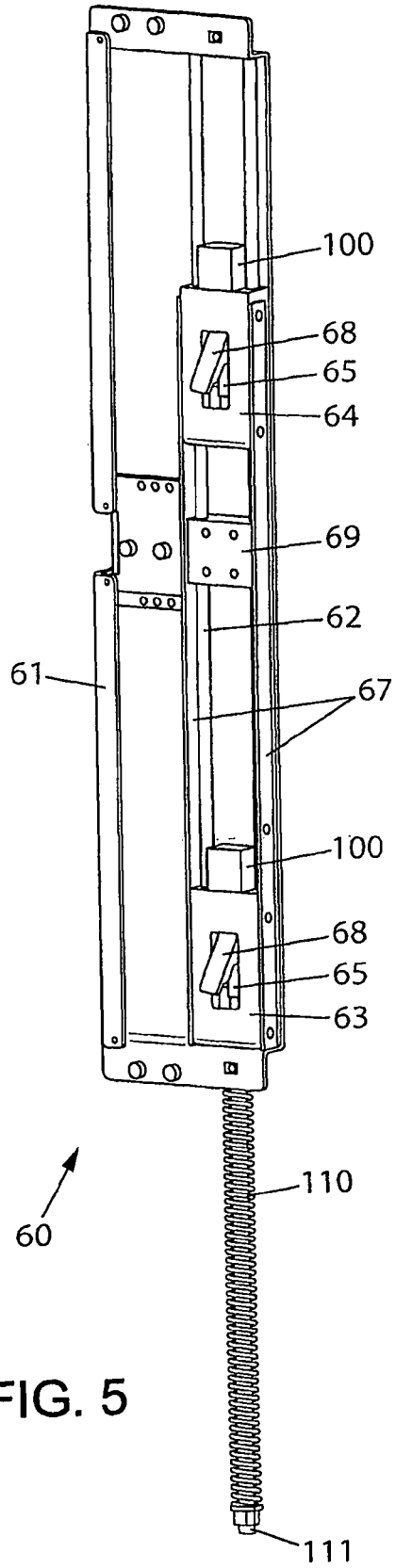
FIG. 5 is a perspective view of another embodiment of a safety device.

To circumvent this problem, an arrangement of the safety device 60 such as the one shown by way of example in FIG. 5 may be used.

In this embodiment, the safety device 60 has one bracket 61 with two sliding support blocks 63, 64 mounted thereon. The two support blocks 63, 64 are connected together by lateral stringers 67 to form a rigid carriage supporting the two retractable stopping elements 68, each received in a vertical slot 65 of a respective support block 63, 64. As in the previously described embodiment, each support block is fitted with an electromagnetic actuator 100 and with a position sensor mounted in slot 65. It will be appreciated that, as an alternative to the two support blocks 63, 64 connected together by stringers to form a carriage, it is possible to provide the support carriage as one block carrying the two retractable stopping elements 68.

The support carriage 63, 64, 67 is slidably mounted on the vertical guide rods 62 whose central portion can be maintained in place by means of a plate 69 fixed to the bracket 61. The lower part of the support carriage is connected to the rod 111 which guides the compression spring 110. This spring 110 can have the length required both to be strong enough to withstand the impact of the safety brake triggering lever on any of the two stopping elements 68 and to be contracted by at least the maximum stopping distance of the car 24 with the safety brake 42 without interfering with another component of the elevator system. The spring 110 accommodates the vertical sliding movement of the support carriage and of the two retractable elements 68 when the catch portion of one of these two elements engages the triggering member of the safety brake. Its stroke is preferably greater than one tenth of the fixed distance between the two retractable elements. When this distance is 800 mm, it means that the stroke is at least 80 mm. A typical value is about 200 mm.

Figure 6:
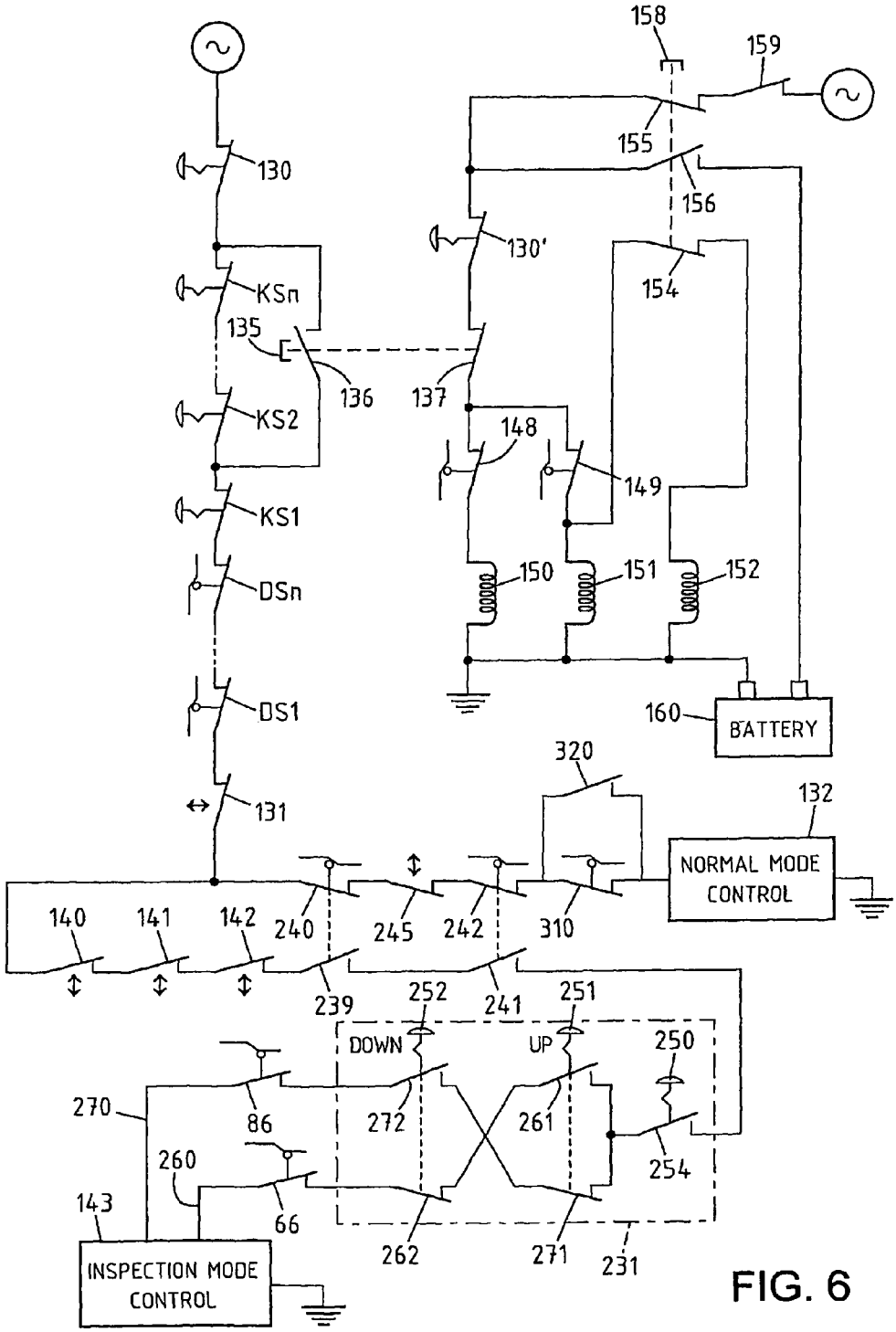
FIG. 6 is a diagram of an example of electrical circuit used in an embodiment of an elevator according to the invention.

FIG. 6 shows an embodiment of an electric circuit usable in an elevator having n landing levels, a single level safety device 80 as shown in FIG. 3 near the lowest landing level and a double level safety device 60 as shown in FIG. 5 near the highest landing level. Power supply to the motor and brake of the drive system is made from an AC source such as the mains via a safety chain including a number of series-connected switches. When the brake is not powered, it is in a state which blocks the motor axle to stop the car. When all the series-connected switches are closed, the elevator is considered to be in a safe condition: the motor can be energized and the brake can be released. The safety chain includes a branch for controlling normal operation of the elevator and a branch for controlling inspection operation. These two branches have a number of switches in common including, in a non-limiting manner:

- one or more emergency switches 130 which an operator may open manually in case of danger;
- n bi-stable key switches KS1-KSn coupled with safety locks mounted on the upper lintels of the n landing doors;
- n switches DS1-DSn respectively associated with the n landing doors, the switch DSi being closed under the condition that the landing door of level i is completely closed;
- a switch 131 which is opened upon triggering of the safety brake 42.

Each safety lock is operated with a special key such as a triangle key when someone needs to have access to the elevator shaft. Manual opening of the landing door of level i using the special key opens the corresponding key switch KSi, which can only be closed once the door of level i is closed and the safety lock brought back to its locking position by means of the key.

Figure 7:
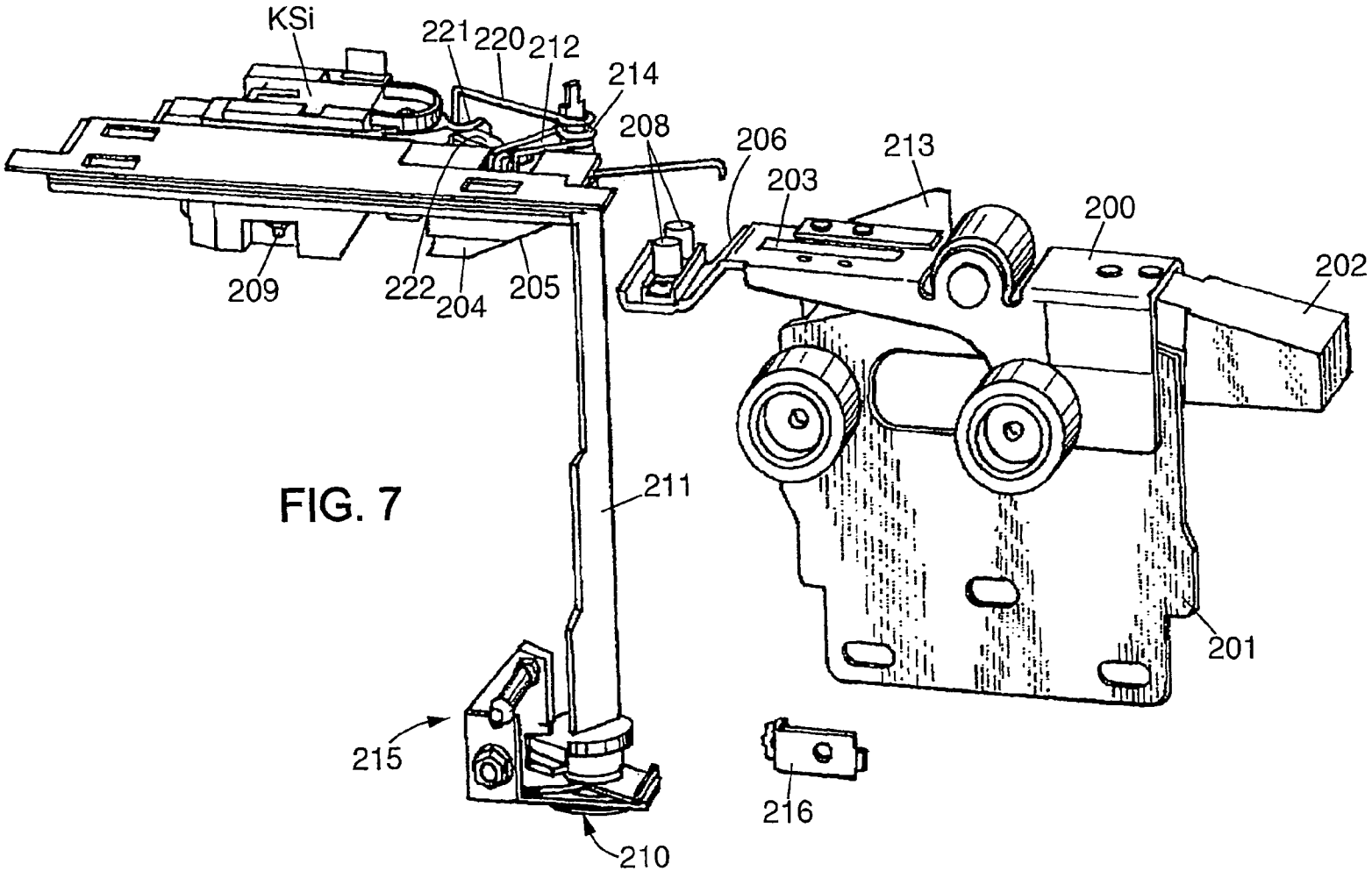
FIG. 7 is a perspective view of a door safety device usable in certain embodiments of the invention.

An example of such safety lock fitted with a bi-stable switch is disclosed in international patent application No. PCT/IB05/000276 and depicted in FIG. 7. It includes a latch mechanism for the landing door, having a latch 200 which is pivotally mounted about a horizontal axis on a support 201 fixed on the door frame. The action of a counterweight 202 brings the latch 200 into the locking position. The latch 200 comprises a slit 203 which cooperates with a hook 204 fixed on the door lintel. The front side of the hook 204 is in the form of a ramp 205 engaged by a slanted portion 206 of the latch 200 as the door is being closed by the action of another counterweight (not shown). When the door is completely closed, the hook 204 sits in the slit 203 to lock the door shut. The end of the latch 200 beyond the slanted portion 206 carries a shunt having a pair of conducting pads 208. This shunt belongs to the door switch DSi of the landing door, with a pair of contacts 209 mounted on the lintel. When the door is closed and locked, the pads 208 are against the contacts 209, thus closing the switch DSi.

In a normal operation of the elevator, the door is unlocked when necessary by tilting the latch 200 against the counterweight 202. The door can also be opened manually by means of the triangle key inserted into a door release input 210 accessible from the outside of the shaft, typically on the upper lintel of the landing door. Actuation of the triangle key in a release direction rotates a spindle 211 counterclockwise against a spring 214 fitted at the end of the spindle 211. The distal end of the spindle 211 has a vane 212 which cooperates with a ramp 213 provided on the latch 200 to release the latch mechanism when the spindle 211 is rotated counterclockwise. The operator can then slide the landing door manually to have access to the shaft. A blocking device 215 mounted near the door release input 210 prevents the spindle 211 from being rotated clockwise while the door is not completely closed. When the door is completely closed, the blocking device 215 is released by the engagement of a bumper 216 mounted on the door frame, so that the spindle 211 can be rotated clockwise by actuating the triangle key in a locking direction at the door release input 210.

The spring 214 has a radial extension 220 which engages a control lever 221 of the bi-stable switch KSi when the spindle 211 is rotated counterclockwise by the actuation of the triangle key in the release direction. This opens the bi-stable switch KSi. Closing the bi-stable switch KSi is done by a pad 222 which may be located on the back side of the vane 212, and which pushes the control lever 221 back to its original position when the spindle 211 is rotated clockwise by actuating the triangle key in the locking direction once the door has been closed.

Switching from the normal mode of operation to the inspection mode is made by pushing a mode button 135 which, in the example considered here, is located on the car roof. Mode button 135 controls the positions of two inspection operation switches 136, 137 so that switch 136 is closed and switch 137 is open when the inspection mode of operation is selected. Inspection operation switch 136 is connected in parallel with the series of the n−1 key switches KS2-KSn associated with the safety locks of all the landing doors but the lowest. These n−1 landing doors are those from which access to the car so roof is possible. The bi-stable switch KS1 of the lowest landing level is connected in series with the n−1 other bi-stable switches KS2-KSn and with the branch including the inspection operation switch 136.

Key switches KS2-KSn are used as detectors of someone's presence on the car roof. When a landing door is opened by means of the special key, it is assumed that someone has clambered on top of the car so that normal operation is prevented. Inspection operation can take place, but only after the mechanic actuates the mode button 135 on top of the car. In any event, car movement in normal mode will only be possible after the mechanic checks out with the triangle key by operating the safety lock of the door by which he entered the hoistway.

The normal operation branch further includes switches 240, 242, 245, 310, 320 described further below. It may include other switches of the safety chain, depicted diagrammatically by block 132 in FIG. 6. The inspection operation branch includes the series-connected switches 140, 141, 142 of the three position sensors 115 belonging to the two safety devices 60, 80 and other switches described further below. Therefore, a car movement in the inspection mode is enabled if all the three retractable stopping elements of the safety devices are in their stopping positions, and prevented otherwise.

The coils 150, 151, 152 of the electromagnetic actuators 100 of the three retractable stopping elements are supplied with power from an AC source which may be the same source as for the safety chain or another source. The coil 150 of the lower safety device 80 is connected in series with a switch 148 positioned within the shaft to cooperate with the cam surface 70 mounted on the car structure or another cam. Switch 148 is open unless the car 24 is located under a level near and above the lowest landing level. Switch 148 is for example collocated with the lower limit switch 86 and open when switch 86 is closed and vice versa. It can also be located slightly above switch 86. Due to switch 148, the stopping element 88 of the safety device 80 cannot be retracted unless the car comes close to the pit, thus enabling the car to reach the lowest landing level in a normal operation.

Likewise, the coil 151 actuating the lower stopping member 68 of the upper safety device 60 is connected in series with a switch 149 so positioned in the shaft that this stopping element 68 cannot be retracted unless the car comes relatively close to the shaft ceiling. Switch 149 is open unless the car 24 is located above a level near and below the highest landing level. Switch 149 is for example collocated with the upper limit switch 66 and open when switch 66 is closed and vice versa. It can also be located slightly below switch 66. The switch 149 enables the car 24 to reach the highest landing level in a normal operation. The coil 152 actuating the upper stopping member of the upper safety device 60 is also connected in series with the switch 149 unless another switch 154 is open in a manual rescue operation (MRO).

The two switches 148, 149 are connected to the inspection operation switch 137 to prevent the retraction of the stopping elements 68, 88 in the inspection mode. One or more emergency switches 130' which an operator may open manually if necessary can be connected in series with the inspection operation switch 137 to make sure that the retractable stopping elements remain deployed if a dangerous condition is signaled.

FIG. 6 also shows a battery 160 which can be used to energize the coils 150-151 in MRO mode. This mode is selected by means of a button or other control member when it is necessary to evacuate the elevator. Activation of the MRO button 158 opens the above-mentioned switch 154 and a second switch 155 and closes a third switch 156. The battery 160 has a terminal connected to the coils 150-152 and its other terminal connected to the emergency switch 130' via switch 156 which is closed only when the MRO mode is selected. Therefore, in MRO mode, the ultimate safety volume is always preserved at the top of the shaft since coil 152 is deactivated. This does not prevent people from being evacuated from the car, but it avoids danger for a person which may happen to be on the car roof at the time of selecting the MRO mode. In MRO mode, coil 150 is energized when its associated switch 148 is closed because the car 24 has moved close to the pit, at or below the vertical position associated with switch 148. Likewise, coil 151 is energized when its associated switch 149 is closed because the car 24 has moved close to the shaft ceiling, at or above the vertical position associated with switch 149. Thus, the working spaces defined by the stopping elements controlled by coils 150 and 151 are not always preserved in MRO mode, which can be helpful to evacuate the elevator car at the lowest or highest landing level.

When the MRO mode is not selected, switch 155 is closed so that AC power can be supplied to the coils 150-152 via an additional switch 159 which belongs to a relay associated with the normal operation control module 132. The relay switch 159 is closed when the normal operation is enabled, the elevator condition being detected as safe. This controls the normal behavior of the retractable stopping elements 68, 88 which are only retracted when the car comes close to them in the normal operation of the elevator.

FIGS. 8-11 illustrate a possible layout of the car roof, with a foldable handrail 230A, 230B and the inspection control interface 231 including, in particular, the mode button 135. In this embodiment, the handrail has a right part 230A which is first unfolded by the mechanic from the front (landing) side 232 after the landing door has been manually opened, and a left part 230B which is then unfolded from the front side. Each handrail part 230A, 230B is for example made of welded metallic tubes, with front and rear upright tubes 233, 234 having their base hinged on the lateral sides of the car roof.

In the embodiment shown, the total height of the handrail folded in the fully retracted position can be very low, for example about 8 cm. The left handrail part 230A lies directly on the car roof in the folded position (FIGS. 8-9). The right handrail part 230A lies over the left part 230B in the folded position.

FIG. 8 shows the right handrail part 230A while it is being unfolded. The base of its upright tubes 233, 234 is hinged to the car roof about axes 235. Each axis 235 is fitted with a helical spring, which, when the handrail part 230A is completely deployed, pushes the upright portion into a vertical channel 237, as depicted by the arrow in FIG. 9. The handrail part 230A is then locked by the channel in the fully deployed position until the mechanic pulls the handrail part toward the front side 232. This pulling action takes the upright tubes 233, 234 out of their channel 237 against the spring, which makes it possible to fold back the handrail portion 230A.

Figure 10:
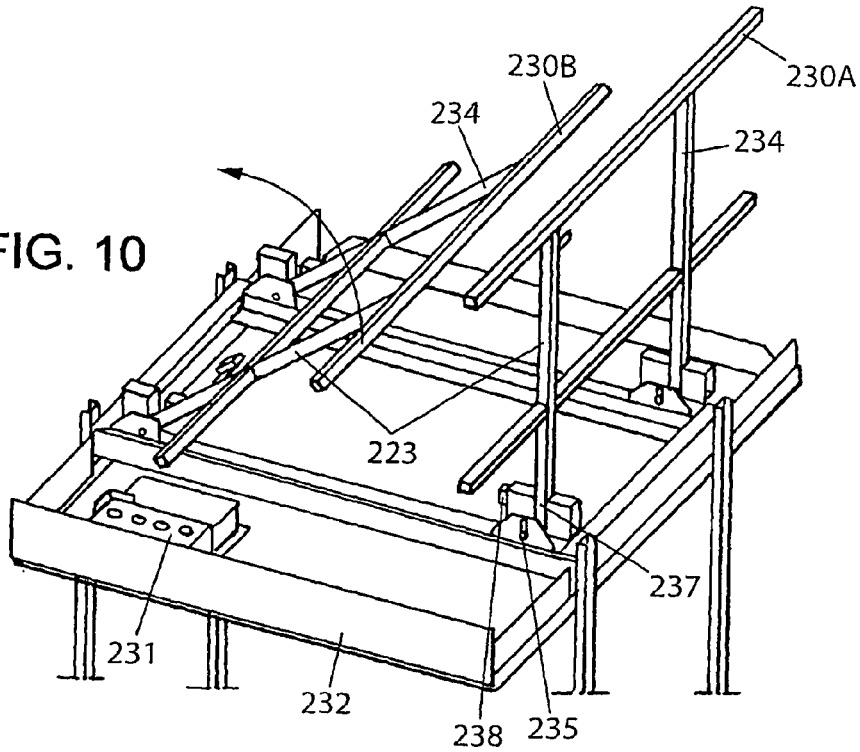
Figure 11:
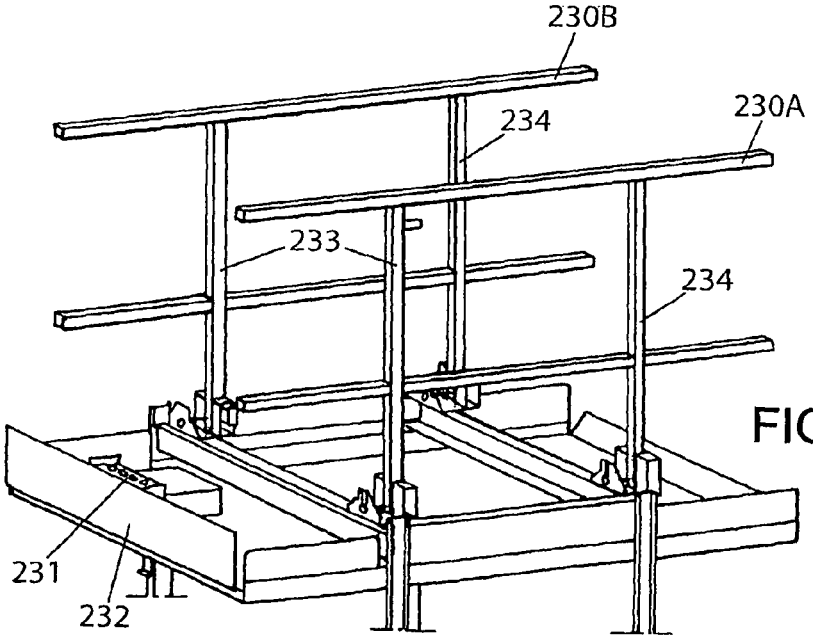

A similar mounting of the left handrail portion 230B is provided. The unfolding of the left handrail portion 230B is illustrated by FIGS. 10 and 11.

For each handrail portion 230A, 230B, one of the two articulations of the upright tubes 233, 234 is equipped with a position sensor 238 which detects the condition of complete unfolding of the handrail portion. In this embodiment, the sensor 238 is mounted in the support on which the upright tube 233 on the front side of the car roof is articulated. On the right part 230A of the handrail, the position sensor 238 has two safety switches 239, 240 shown in the electrical diagram of FIG. 6. Switch 239 is closed when the right upright tube 233 sits in the channel 237 of the support equipped with the position sensor 238, and open when the upright tube 233 is out of that channel 237. Conversely, switch 240 is open when the upright tube 233 sits in the channel 237, and closed otherwise. Symmetrically, the position sensor 238 associated with the left handrail part 230B has two switches 241, 242 also shown in FIG. 6. Switch 241 is closed and switch 242 is open when the left upright tube 233 sits in its channel 237, while switch 241 is open and switch 242 is closed when the left upright tube 233 is out of its channel 237.

The two safety switches 249, 241 are connected in series with the above-described switches 140-142 in the inspection operation branch of the safety chain. Therefore, movement of the car in the inspection mode is only authorized when the two handrail parts 230A, 230B are in their completely deployed positions, thus ensuring the safety conditions for the mechanic standing on the car roof.

The two safety switches 240, 242 are connected in series in the normal operation branch of the safety chain, so that movement of the car is prevented in the normal mode if the mechanic has forgotten to fold back one or both of the handrail parts 230A, 2308.

If necessary, an alternative embodiment of the foldable handrail includes a third handrail part (not shown) for protecting the rear side of the car roof. Such a third handrail part can be hinged to the car roof or preferably to one of the left and right handrail parts 230A, 230B to be unfolded by pivoting about a vertical axis on the rear side of that handrail part once it has been unfolded to its upright position. If such a third handrail part is provided, it is also fitted with a position sensor to determine whether or not it is in its completely unfolded position where the third handrail part stands along the rear side of the car roof. A switch of this position sensor is closed when the rear handrail part is completely deployed, and is connected in series with switches 239, 241 of the inspection operation branch, in order to make sure that all the handrail parts are completely deployed prior to authorizing inspection movements of the car.

As shown in FIGS. 8-11, the foldable handrail is also fitted with another switch 245, whose function is to detect whether the handrail has been completely folded back on the car roof.

This switch 245 is preferably mounted on one of the handrail parts 230B. It has a spring which biases it into its default state which is an open state. One of the tubes constituting the other handrail part 230A has an extension 246 which presses switch 245 against the action of its spring when the two handrail parts are completely folded, thus closing switch 245. This switch 245 is connected in series with the above-described switches 240, 242 in the normal operation branch of the safety chain. Therefore, movement of the car is only enabled in the normal mode when the handrail is completely retracted, thus avoiding damages to the structure in a low overhead configuration.

FIG. 12 is a front view of the inspection control interface 231 located on the car roof in the embodiment of FIGS. 8-11. The control interface 231 includes the mode button 135 whose function has been described previously with reference to FIG. 6. In the illustration of FIG. 12, this button 135 is in the form of a rotating knob for selecting the normal or inspection mode of operation. Alternatively, it is operated with a key.

The inspection control interface 231 also includes three control members 250-252 for controlling movement of the car in the inspection mode, namely a common button 250, an up button 251 and a down button 252. To control an upward (or downward) inspection movement of the car, the mechanic must in principle use both hands to simultaneously press the common and up buttons 250, 251 (or the common and down buttons 250, 252).

As shown in FIG. 6, activating (pressing) the common button 250 closes a common switch 254 which is connected in series in the inspection operation branch of the safety chain, so that no movement of the car is allowed in the inspection mode unless the common button has been pressed. Beyond the common switch 254, the inspection operation branch is divided into two parallel sub-branches 260, 270 forming power lines for controlling upward and downward movements of the car, respectively, in the inspection mode.

The up sub-branch 260 includes the above-described upper limit switch 66. Therefore, when the upper limit switch 66 is open because the car is close to the top of the shaft, the upward movements of the car are prevented in the inspection mode. However, downward movements are not prevented because the upper limit switch 66 does not belong to the down sub-branch 270. Likewise, the down sub-branch 270 includes the lower limit switch 86 described previously. Accordingly, the lower limit switch 86 prevents downward movements of the car in the vicinity of the pit in the inspection mode, but does not prevent upward movements.

The up sub-branch 260 includes two other switches 261, 262 located in the housing of the control interface 231 and connected in series with the upper limit switch 66. Switch 261 is closed only when the up button 251 is activated (completely pressed), while switch 262 is closed when the down button 252 is deactivated (not completely pressed). Symmetrically, the down sub-branch 270 includes two switches 271, 272 located in the housing of the control interface 231 and connected in series with the lower limit switch 86. Switch 272 is closed only when the down button 252 is activated, while switch 271 is closed when the up button 251 is deactivated.

Another safety feature advantageously provided in an elevator according to the invention relates to the toe guard mounted underneath the lower front sill of the car. The arrangement of the toe guard 300 according to an embodiment of the invention is illustrated in the FIG. 13. It includes a toe guard plate 301 extending in a vertical plane and mounted on two vertically extending brackets 302 fixed to the rear side of the lower door sill bracket 303. The toe guard plate 301 can slide vertically between a lowermost position illustrated in FIG. 13 and an uppermost position.

In the embodiment shown, the toe guard plate 301 has six riveted studs 305, 306. Four of the studs 305 are positioned to be received in four corresponding slits 307 provided in the brackets 302 to guide the vertical movement of the toe guard plate 301. The two other studs 306 are disposed to be slidably received in two corresponding vertical slits 308 provided in the lower door sill bracket 303.

The toe guard system 300 shown in FIG. 13 is passive. Except near the pit bottom, its normal condition is the lowermost position shown in FIG. 13, which it adopts due to its own weight. In the normal operation of the elevator, the base of the toe guard plate 301 can strike the pit floor, which causes the toe guard plate to slide upward. The vertical stroke of the plate 301 is selected depending on the depth of the pit. A dangerous situation may occur if the toe guard plate 301 does not return to its lowermost position once the car has left its lowermost level. Such an abnormal position of the toe guard is advantageously detected by a switch 310.

The safety switch 310 is operated by a resiliently biased operating arm 311. The operating arm carries a wheel 312 at its distal end which acts as a cam follower. The body of the switch 310 is mounted to the edge of one of the vertical brackets 302. A corresponding cam surface member 313 is mounted to the rear of the toe guard plate 301.

During normal use of the elevator the toe guard plate 301 hangs down in the fully deployed position shown in FIG. 13. In this position, the cam follower wheel 312 rests against the middle section of the cam surface 313, which keeps the safety switch 310 in its closed state. As soon as the toe guard plate 301 is lifted from the fully deployed position by the pit floor as the car 24 approaches the lowest landing level, the cam surface 313 lets the operating arm 311 bend to open the safety switch 310.

Normally, as the car moves up from the lowest lading level, the toe guard plate 301 is lowered back to its lowermost position in which the safety switch 310 is closed. It can happen, however, that the toe guard is jammed in a position which is not fully deployed, or that some obstacle present in the shaft interferes with the lower edge of the toe guard plate 301 as the car is moving down. In such a situation, the safety switch 310 is open, which prevents any further movement of the car in the normal operation of the elevator.

This functioning is obtained by connecting the toe guard safety switch 310 in series in the normal operation branch of the safety chain, as shown in FIG. 6. In order to allow normal movements of the car 24 near the pit as the toe guard operates properly, a shaft bottom switch 320 is connected in parallel with the safety switch 310. The shaft bottom switch 320 is closed when the car is in a selected distance range close to the pit floor, thus bypassing the safety switch 310, and open when the car is above the selected range.

As shown in FIG. 1, the shaft bottom switch 320 can be located between the lower limit switch 86 and the pit floor to cooperate with the cam surface 70 or another cam surface provided o the car body.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

The invention claimed is:

1. An elevator comprising:

a car movable vertically within an elevator shaft between lower and upper end positions;

a drive system coupled to a traction system for controlling movement of the car; and at least one limit switch which is open when the car is in a selected distance range from one of the end positions, the limit switch forming part of a power line supplying power to the drive system for controlling movement of the car in a direction towards said one of the end positions in an inspection operation such that movement of the car is prevented only in said direction when the car is in said distance range in an inspection operation;

a first control member having an activated state for selecting a first direction towards said one of the end positions for movement of the car in an inspection operation, and a deactivated state;

a first switch coupled to the first control member to be closed in the activated state of the first control member and open in the deactivated state, the first switch being connected in series with said limit switch in a first power line supplying power to the drive system for controlling movement of the car in the first direction in an inspection operation;

a second switch coupled to the first control member to be open in the activated state of the first control member and closed in the deactivated state of the first control member, the second switch forming part of a second power line supplying power to the drive system for controlling movement of the car in a second direction, opposite said first direction, in an inspection operation;

a second control member having an activated state for selecting said second direction for movement of the car in an inspection operation and a deactivated state;

a third switch coupled to the second control member to be closed in the activated state of the second control member and open in the deactivated state, the third switch being connected in series with the second switch in the second power line;

a fourth switch coupled to the second control member to be open in the activated state of the second control member and closed in the deactivated state of the second control member, the fourth switch being connected in series with said limit switch and the first switch in the first power line; and a common switch coupled to a common control member and forming part of an inspection power line to which said first and second power lines are connected in parallel.

2. The elevator as claimed in claim 1, comprising:

a safety brake for stopping the car when triggered; and a retractable stopping element deployed in an inspection operation for engaging a triggering member of the safety brake when the car moving in said direction reaches a selected distance within said distance range so as to secure a safety space independently of the drive system at said one of the end positions in the inspection operation.

3. The elevator as claimed in claim 1, comprising another limit switch which is open when the car is in a second selected distance range from the other one of the end positions, the other limit switch being connected in series with said second and third switches.

4. The elevator as claimed in claim 3, comprising:

a safety brake for stopping the car when triggered; and a retractable stopping element deployed in an inspection operation for engaging a triggering member of the safety brake when the car moving in the second direction reaches a selected distance within said second distance range so as to secure a safety space independently of the drive system at the other one of the end positions in the inspection operation.

5. An elevator comprising:

a car movable vertically within an elevator shaft between lower and upper end positions;

a drive system coupled to a traction system for controlling movement of the car; and at least one limit switch which is open when the car is in a selected distance range from one of the end positions, the limit switch forming part of a power line supplying power to the drive system for controlling movement of the car in a direction towards said one of the end positions in an inspection operation such that movement of the car is prevented only in said direction when the car is in said distance range in an inspection operation;

a foldable handrail mounted on top of the car;

a plurality of safety switches associated with the foldable handrail, the safety switches comprising a first safety switch closed only when the handrail is folded in a fully retracted position and at least one second safety switch closed when the handrail is unfolded in a fully deployed position; and a safety chain comprising a normal operation branch including said first safety switch for supplying power to the drive system in a normal operation of the elevator and an inspection operation branch including said at least one second safety switch for supplying power to the drive system in an inspection operation of the elevator.

6. An elevator comprising:

a car movable vertically within an elevator shaft between lower and upper end positions;

a drive system coupled to a traction system for controlling movement of the car; and at least one limit switch which is open when the car is in a selected distance range from one of the end positions, the limit switch forming part of a power line supplying power to the drive system for controlling movement of the car in a direction towards said one of the end positions in an inspection operation such that movement of the car is prevented only in said direction when the car is in said distance range in an inspection operation;

a shaft bottom switch which is closed when the car is within a selected distance from the lower end position and open when the car is beyond the selected distance from the lower end position;

a retractable toe guard mounted at the bottom of the car;

a safety switch which is closed only when the toe guard is in a fully deployed position; and a power line for supplying power to the drive system in a normal operation of the elevator, said power line including a parallel arrangement of the shaft bottom switch and of the safety switch.

7. An elevator comprising:

a car movable vertically within an elevator shaft between lower and upper end positions;

a drive system coupled to a traction system for controlling movement of the car; and at least one limit switch which is open when the car is in a selected distance range from one of the end positions, the limit switch forming part of a power line supplying power to the drive system for controlling movement of the car in a direction towards said one of the end positions in an inspection operation such that movement of the car is prevented only in said direction when the car is in said distance range in an inspection operation;

a plurality of landing doors providing access to the shaft;

a plurality of door safety devices each coupled to a latch mechanism of a respective landing door, each door safety device having a door release input for releasing the latch mechanism of the respective landing door in response to a first user action performed outside the shaft, and a bi-stable switch which is opened in response to said first user action and closed in response to a second user action performed outside the shaft, the second user action being enabled only when the respective landing door is completely closed;

an inspection control interface located, inside the shaft, comprising a mode switch closed by a user to select the inspection operation of the elevator; and a safety chain comprising a plurality of series-connected switches for supplying power to the drive system, the plurality of series-connected switches comprising at least one of the bi-stable lock switches bypassed by a branch including said mode switch.

* * * * *